United States Patent [19]

Hochstein

[11] 4,117,495

[45] Sep. 26, 1978

[54] SELF-TUNING DEPLOYABLE ANTENNA

[76] Inventor: Peter A. Hochstein, 14020 15 Mile Rd., Sterling Heights, Mich. 48077

[21] Appl. No.: 773,155

[22] Filed: Mar. 1, 1977

[51] Int. Cl.[2] ..... H01Q 11/12; H01Q 9/00; H01Q 1/12; H01Q 1/10

[52] U.S. Cl. ..... 343/877; 343/723; 343/745; 343/901

[58] Field of Search ..... 343/745, 723, 861, 900, 343/877, 901, 903

[56] References Cited

U.S. PATENT DOCUMENTS

| | | | |
|---|---|---|---|
| 2,157,278 | 5/1939 | Blackmore | 343/877 |
| 2,839,752 | 6/1958 | Webster | 343/745 |
| 2,894,260 | 7/1959 | Ellis | 343/745 |
| 3,146,450 | 8/1964 | Dooner | 343/723 |
| 3,541,568 | 11/1970 | Lowenhar | 343/877 |
| 3,909,830 | 9/1975 | Campbell | 343/745 |

*Primary Examiner*—Alfred E. Smith
*Assistant Examiner*—Harry E. Barlow
*Attorney, Agent, or Firm*—McGlynn and Milton

[57] ABSTRACT

An extensible antenna assembly defined by a strip wound into a coil and extensible out of the coil through a guide for forming the strip into an elongated tubular length. In two embodiments the strip is made of a metal whereby the tubular length establishes the antenna for radiating and receiving radio frequency energy and the coiled or wound coil portion defines a coil integrally coupled and electrically continuous with the tubular portion to define a variable inductive reactance for automatically maintaining the antenna resonant to a predetermined frequency in correlation with and responsive to the extended position of the antenna. An insulating means, comprising a strip in the first embodiment and a conical spindle in the second embodiment, insulates the turns of the strip defining the coil and is configured to change the inductance of the coil non-linearly in response to linear movement of the antenna. In an alternative embodiment, a separate coil is associated with the strip and includes a movable contact associated with the coil for varying the inductance of the coil in response to winding and unwinding movement of the strip. In yet another embodiment, a separate coil is associated with the strip and a permeable core is moved into and out of the coil for varying the inductance in response to movement of the strip. In still another embodiment, the strip may be non-conductive and supports a separate conductor with the conductor defining the antenna along the tubular portion of the strip and the coil along the wound portion of the strip.

26 Claims, 9 Drawing Figures

SELF-TUNING DEPLOYABLE ANTENNA

The subject invention relates to an elongated antenna of the type for radiating and receiving radio frequency energy. Typically a coupling is connected to the antenna for transferring power to and from the antenna, as, for example, between the antenna and a transceiver.

The efficiency of a vertically disposed antenna operating at a selected radio frequency depends upon its physical length relative to the wave length of selected or operating radio frequency, each radio frequency having a different wave length. In other words, for a selected frequency, or range of frequencies, a length of wire may be calculated for utilization as an antenna for optimal radiating and receiving of radio frequency energy at the selected frequency. The length of the antenna wire for a given wave length could vary depending upon the characteristics of the wire such as its diameter. As is well known in calculating the optimal length of vertical antennas, the total length of the antenna radiating element is based upon the wave length of the selected frequency, and is electrically equivalent to one-half or one-quarter of the wave length. For example, the frequencies utilized in the citizens band include frequencies wherein the wave length is approximately 32 feet. A quarter wave length is approximately 8 feet and therefore many antennae utilized for citizens band transceivers are approximately 8 feet in height. The 8 feet height is the actual length of the antenna and is also the "electrical length" which approximates a quarter wave length. Thus, an antenna with an electrical length of 8 feet is "tuned" to the frequency having a wave length of 32 feet. When the antenna is tuned it is resonant. When an antenna is resonant its capacitive reactance equals its inductive reactance and the antenna acts as a pure resistance.

Should an antenna be shortened to a physical height or electrical length of less than 8 feet while operating at a radio frequency having a wave length of approximately 32 feet, the antenna becomes capacitive in that it will exhibit a capacitive reactance as a function of its length. The capacitance of a vertical antenna, which is electrically shorter than one-quarter wave length at the selected frequency, may be calculated.

If an antenna is shorter than one-quarter wave length at a selected frequency, the exhibited capacitive reactance must be compensated for in order to render the antenna resonant at the selected frequency. This is accomplished by providing an equivalent inductive reactance in the antenna circuit to equalize the capacitive reactance to render the antenna resonant. In the past, inductive reactance has been introduced into the antenna by utilizing a coil electrically coupled or in series with the antenna. In other words, for an antenna of a fixed length and capacitance, an inductance has been inserted or electrically coupled with the antenna to render the antenna resonant at a particular or selected frequency. By so coupling a coil to an antenna the "electric length" of the antenna is equivalent to that required for resonance as function of the wave length desired. Coils have been utilized in the past to provide such inductance but they provide a fixed inductance and therefore the antenna is resonant only at one physical length. Antennae are also known where the length of the antenna is fixed but the inductance load on the antenna may be varied to change the frequency at which the antenna is resonant. In other words, there are known in the prior art antenna assemblies wherein a variable inductance is coupled to an antenna and the inductance is varied so as to change the frequency at which the antenna is resonant. Examples of such prior art assemblies are shown in U.S. Pat. Nos. 2,839,752 granted June 17, 1958 to Webster; 2,894,260 granted July 7, 1959 to Ellis; 3,226,725 granted Dec. 28, 1965 to Ritchie, et al.; 3,474,453 granted Oct. 21, 1969 to Ireland and 3,398,654 granted Mar. 19, 1974 to Martino, et al. There is also known in the prior art an antenna system wherein the capacitance coupled with the antenna is varied in accordance with the extension of the antenna to maintain the capacitive reactance of the antenna substantially constant. Such an assembly is shown in U.S. Pat. No. 3,146,450 granted Aug. 25, 1964 to Dooner.

A significant number of retractable or telescoping antennae are also known to the prior art, particularly in the automotive industry. Retractable or telescoping antennae are utilized on automobiles for appearance purposes and to prevent vandalism and/or theft. Of course, such antennas are resonant only at one length and are also subject to water damage, as by freezing; require substantial mounting clearances; are relatively heavy, and are expensive to manufacture.

Accordingly, the subject invention solves many of the problems associated with the prior art antennas by providing an extensible antenna assembly including an elongated antenna for radiating and receiving radio frequency energy and being extensible and retractable longitudinally of its length between a retracted position and a fully extended position with tuning means for automatically maintaining the antenna resonant to a predetermined frequency in correlation with and responsive to the various extended positions of the antenna.

Other advantages of the present invention will be readily appreciated as the same becomes better understood by reference to the following detailed description when considered in connection with the accompanying drawings wherein.

Figure 1:
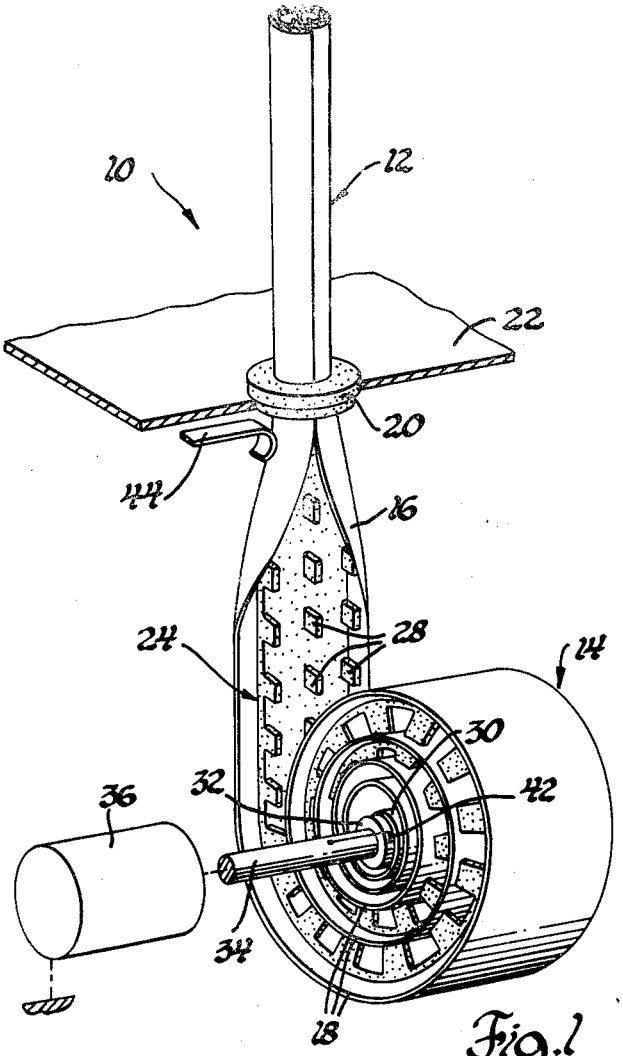
FIG. 1 is a schematic perspective view of a preferred embodiment of the subject invention.
Figure 2:
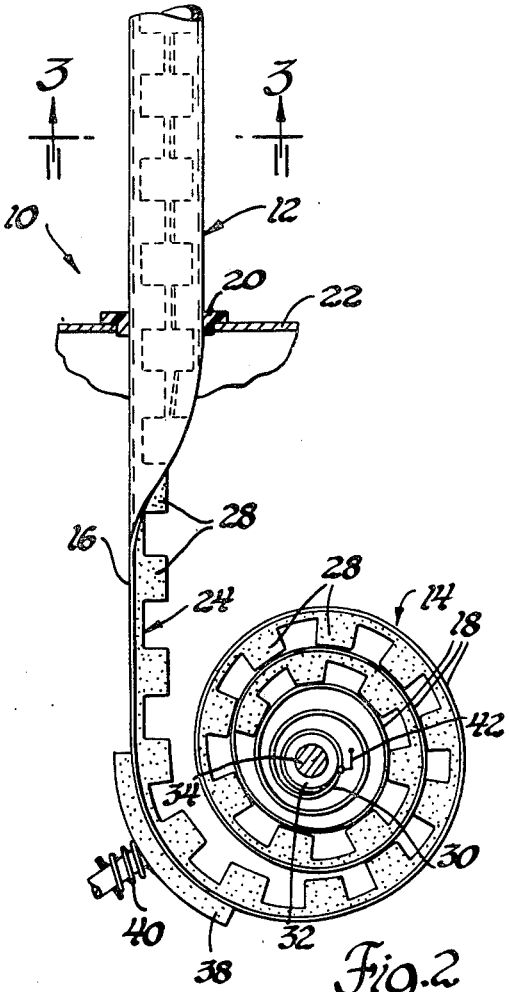
FIG. 2 is a side elevational view of the embodiment shown in FIG. 1.

Referring to the drawings wherein like numerals indicate like or corresponding parts throughout the several views, a first embodiment of an extensible antenna assembly constructed in accordance with the subject invention is generally shown at 10 in FIGS. 1 and 2. The antenna assembly 10 includes an elongated portion generally indicated at 12 for radiating and receiving radio frequency energy and being extensible and retractable longitudinally of its length between a retracted position and a fully extended position. The antenna assembly 10 also includes a tuning means generally indicated at 14 for automatically maintaining the antenna 12 resonant to a predetermined frequency in correlation with and responsive to various of the extended positions of the antenna 12.

Figure 4:
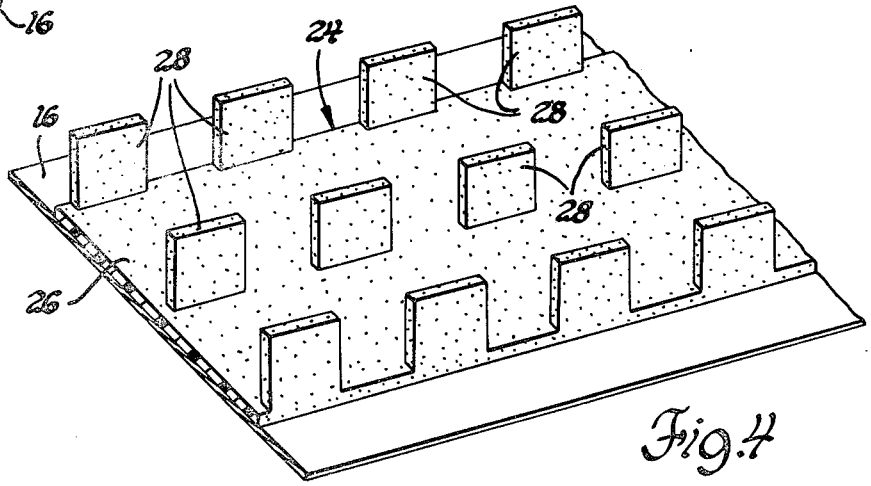
FIG. 4 is an enlarged fragmentary perspective view of a portion of the length of the assembly shown in FIGS. 1 through 3.

The antenna assembly comprises a strip of material 16 having a retracted position, in which at least a major length thereof is in a flat or very thin rectangular cross section, as best illustrated in FIG. 4, and wound into a wound portion having turns 18, and a fully extended position, in which a length thereof defines an elongated portion 12 with a tubular cross-sectional configuration.

There is also included a guide means comprising a collar 20, or the like, seated within a bulkhead 22 for supporting and directing the strip from the generally flat configuration of the wound portion 14 into the tubular configuration of the elongated portion 12, and vice versa. The sleeve or collar 20 may be disposed in a bulkhead 22 which may comprise a portion of the body such as a fender, roof, or the like, in an automobile.

The strip, therefore, establishes the antenna 12 in the elongated portion for radiating and receiving radio frequency energy. The strip also establishes an electrically continuous inductive coil defined by the turns 18 in the wound portion 14 for providing a varying inductance coupled with the antenna portion 12 and varying upon the winding and unwinding of the strip 16 between the elongated portion 12 and the wound portion 14. Thus, the tuning means or wound portion 14 comprises a variable inductive reactance means mechanically coupled with the antenna by being integral therewith. In other words, the inductive reactance means is defined by an inductance coil having turns 18 for responding to the extensive and retractive movement of the antenna 12.

Specifically, in the embodiment of FIGS. 1 through 4, the strip 16 is preferably made of a metal so as to be electrically conductive and defines both the antenna 12 and the coil having the turns 18. The assembly also includes varying and/or insulating means generally indicated at 24 for electrically insulating the turns 18 of the coil in the wound portion 14 from one another and non-linearly varying the inductance of the coil in response to linear movement of the strip 16 into and out of the tubular length or antenna portion 12. Specifically, the varying and/or insulating means 24 comprises a plastic strip 26 having three rows of spaced fingers 28 extending therefrom. The plastic strip 26 may be secured to the strip 16 by flexible adhesives and/or mechanical fasteners.

The purpose of the fingers 28 is to space the turns 18 of the coil from one another and the fingers 28 are of an increasing height from the inner turn 18 of the coil portion 14 toward the distal or outward end of the antenna portion 12 whereby adjacent turns or convolutions 18 of the coil are spaced greater distances from one another radically outwardly from the center of the coil 14 to non-linearly vary the inductance of the coil 14. The turns 18 are disposed in a logrithmic spiral. The strip 16 per se, in its function of being wound and unwound out of and into length 12 of circular cross section, is well known and is exemplified in U.S. Pat. Nos. 3,144,104 to Weir, et al., granted Aug. 11, 1964; 3,144,215 granted to Klein, Aug. 11, 1964 and 3,243,132 to Taylor, et al., granted Mar. 29, 1966.

The inward end 30 of the strip 16 is secured to a hub 32. The hub 32 is secured to a shaft 34 which is, in turn, rotated by a motor 36. The hub 32, the shaft 34 and the motor 36 define a drive means for moving the antenna 12 while at the same time simultaneously operating the varying means by moving the strip 16 into and out of the plurality of turns 18 of the tuning means 14. The hub 32 is appropriately rotatably supported on a support structure which also supports the motor 36. The motor 36 may take the form of a small electrical motor. In addition, an appropriate casing may be disposed about the turns 18. The guide means may also include a backing member 38 which has a curved configuration for engaging the strip 16. The backing member 38 is biased by a spring 40 toward the center of the coil whereby the outer turn of the coil is guided toward the tubular section 12. In other words, the backing plate 38 will move radially inwardly toward the center of the coil as the turns are unwound therefrom.

The radio frequency signal is transmitted to and from the antenna assembly by a contact 42 which engages the edge of the inner turn of the coil which is secured to the hub 32. In other words, the contact 42 is in electrical sliding contact with the edge of the inner coil during all positions of rotation of the hub 32, the inner coil being circular and contiguous with the hub 32.

When the antenna assembly is fully retracted, the tubular length or antenna portion 12 has its upper end juxtaposed to the collar 20. There may be an enlargement or stop at the upper distal end of the tubular portion 12 for engaging the collar 20 when the assembly is in the fully retracted position. When it is desired to extend the antenna assembly, the drive motor 36 is actuated for unwinding the strip 16 out of the turns 18 of the coil. As the fingers 28 decrease in length, the spacings of the turns 18 of the coil decrease and become fewer in number as the antenna portion 12 is extended, thereby varying the inductance of the coil non-linearly as the antenna portion 12 is extended linearly. In other words, the inductance of the coil is an exponential function of the incremental movement or extension and retraction of the antenna portion 12.

The incremental change in the inductance provided by the turns 18 of the coil is greatest at the minimum extension of the antenna portion 12 and becomes progressively or continuously smaller as the antenna 12 is extended. Since the strip 16 is conductive and the antenna 12 is integral with the turns 18 of the coil, the antenna 12 is electrically and mechanically continuous with the turns 18 of the coil.

Figure 3:
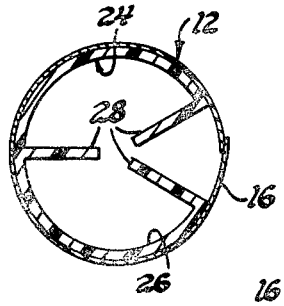
FIG. 3 is a cross-sectional view taken substantially along line 3—3 of FIG. 2.

As exemplified in FIG. 3, the strip 26 of the insulating means is curved into a circular cross section within the tubular portion 12 of the antenna and the edges of the strip 16 overlap one another to define the circular cross section of the tubular antenna portion 12.

Electrical limit switches may be placed in engagement with the strip 16 to coact with a notch or recess in the edge of the strip, or the like, for defining various extended positions of the antenna 12. The antenna portion per se, as defined by the tubular length 12, may be utilized for other bands of radio frequency than that to which the antenna portion 12 and the coil or tuning portion 14 are resonant. For example, in an automotive passenger car equipped with an FM band receiver and a C.B. band communications transceiver, the antenna assembly 10 could be effectively utilized for both devices. As described above, the antenna assembly may be electrically coupled to the citizens band transceiver through the contact 42; however, when the FM radio receiver is utilized, which requires a shorter antenna length, the antenna portion 12 could be extended to approximately 30 inches (which approximates a quarter wave length for the frequencies utilized in the FM band) and the connection between the FM radio receiver and the antenna could be made directly to the antenna portion 12 through a contact 44. Thus, the electrical motor 36 of the antenna drive system could be connected to the FM receiver in the automobile so that, when the FM receiver is turned on, the antenna is automatically extended to an FM position whereby the FM signal is received from the antenna portion 12 through the contact 44, yet the antenna remains resonant to the frequencies of the citizens band transceiver as the antenna assembly is resonant at any extended position of the antenna portion 12.

Figure 5:
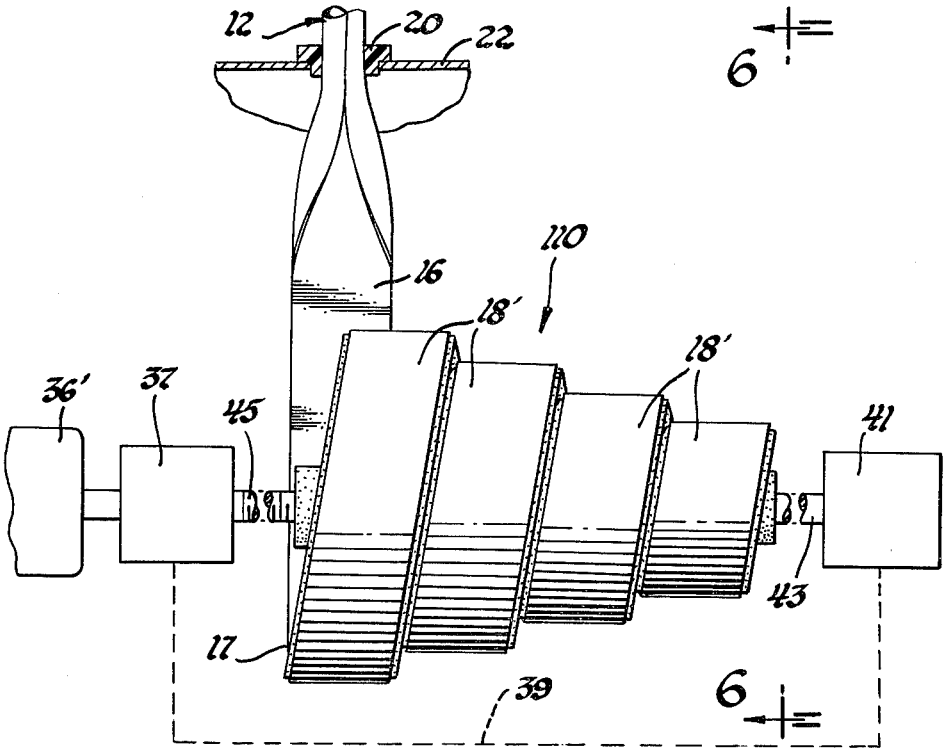
FIG. 5 is a schematic elevational view of a second preferred embodiment of the invention.
Figure 6:
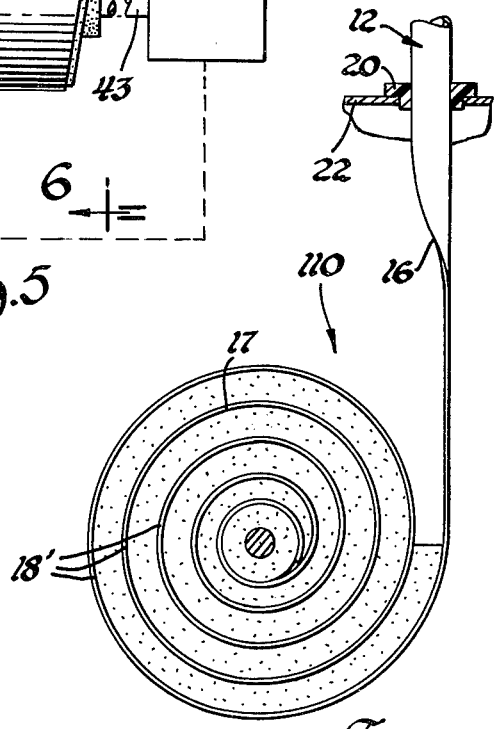
FIG. 6 is a side view taken substantially along line 6—6 of FIG. 5.

Turning now to FIGS. 5 and 6, an alternative embodiment is generally shown at 110. The antenna assembly 110 also comprises a metal strip 16 which is mechanically and electrically continuous or integral between the tubular antenna portion 12 and the tuning means defined by the adjacent turns 18' of a coil which provides the variable inductance. The turns 18' are wound and unwound from a conical spindle having a spiraled support ledge 17 for supporting and spacing the adjacent turns 18' of the coil. The spiraled ledge 17 decreases in diameter from left to right or in the wound direction, as viewed in FIG. 5, and from the center radially outwardly, as is best illustrated in FIG. 6. The tuning means, comprising the variable inductive reactive means in the antenna assembly 110, is defined by the adjacent turns 18', which are established by the spiraled ledge 17. In other words, the spiraled ledge 17, which varys the inductance of the turns 18' of the coil, changes the diameter of the turns 18' and the number of turns 18' as well as the spacing between the turns 18' of the coil. The ledge 17 is also configured to non-linearly vary the inductance in response to linear movement of the strip 16, as by varying the distance between adjacent turns 18'.

The drive means for moving the strip 16 includes an electric motor 36' which drives a gear box 37. The gear box 37 is mechanically connected through an appropriate motion transmitting system 39 to a drive coupler 41 which rotates a shaft 43. The system 39 may comprise a speedometer type cable wherein a flexible rotatable cable is supported in a conduit. The shaft 43 is connected to the spindle to rotate the spindle but through a lost motion connection which allows the spindle to move axially of the shaft 43. Such a connection may comprise a pin extending radially from the shaft 43 and slidably disposed in an axially extending slot in the conical spindle. A threaded shaft 45 extends from the gear box 37 and threadedly engages the spindle for moving the spindle axially of the shafts 43 and 45 as it is being rotated by the shaft 43. By moving the spindle axially the ledge 17 is aligned with the guide collar 20 as the strip is wound and unwound from the spiral core 17. Of course, the spindle electrically insulates the adjacent turns 18' of the coil from one another and also establishes a logarithmic relationship between adjacent turns 18' of the coil. Thus, the antenna portion 12 of the assembly of FIGS. 5 and 6 is maintained resonant to a predetermined frequency by the tuning means defined by the adjacent turns 18' in correlation with and responsive to the extended position of the antenna portion 12.

Figure 7:
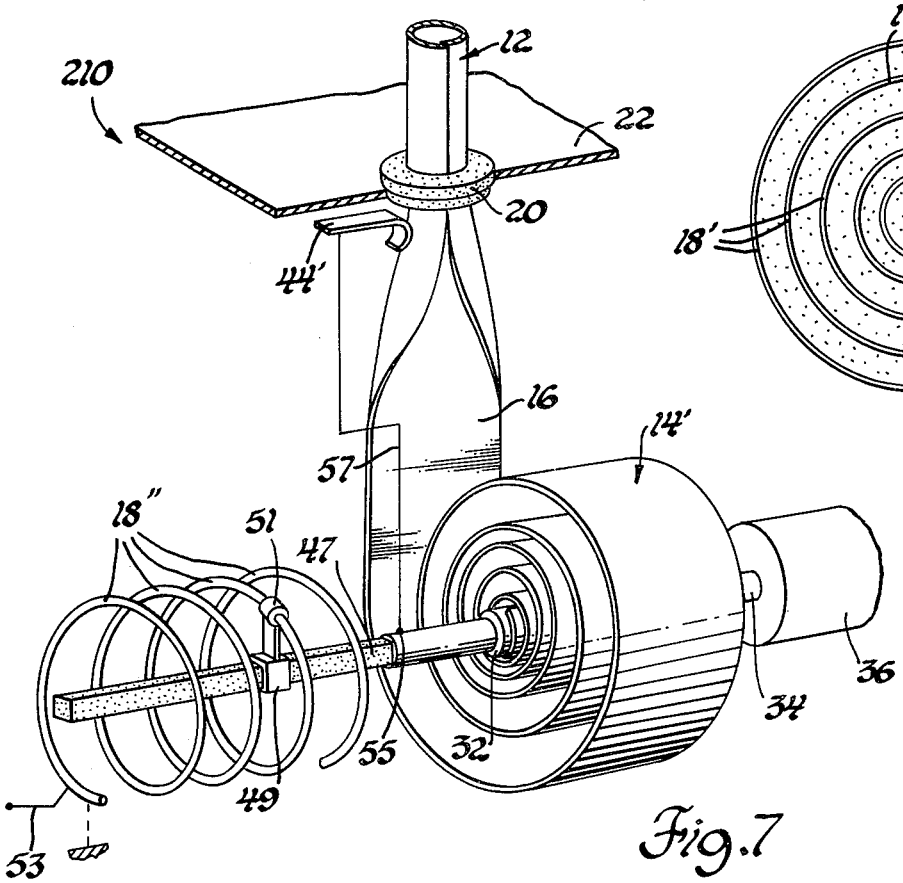
FIG. 7 is a schematic perspective view showing another embodiment of the subject invention.

Yet another embodiment of the invention is generally shown at 210 in FIG. 7. The embodiment of FIG. 7 includes a metal strip 16 which is wound and unwound into adjacent turns defining the wound portion 14' by a drive means including a motor 36, a shaft 34 and a hub 32. The embodiment of FIG. 7 differs from the previous embodiments in that the coil defining the variable inductive reactance means is separate from the strip 16 and includes the adjacent turns 18''. An electrically conductive shaft 47, having a square cross section along its outer end, is rotated by the hub 32. A sleeve 49 having a square opening is in mating engagement with the shaft 47 for sliding movement therealong while being rotated by the shaft 47. The sleeve 49 supports an electrical contact 51 through an integral arm and the contact 51 engages or moves along the spirally disposed turns 18'' of the coil. The sleeve 49, the contact 51 and the interconnecting arm are all electrically conductive. The RF signal passes through a lead 53 to the turns 18'' of the coil then through the contact 51 and sleeve 49 to the shaft 47. The signal then passes along the shaft 47 and through a contact 55 and a lead 57 to a contact 44'. The contact 44' slidably engages the antenna portion 12 and the contact 55 slidably engages the circular portion of the shaft 47. The adjacent turns 18'' of the coil may vary the inductance produced by the coil as the contact 51 moves thereabout to vary the number of turns. In addition, the inductance may be varied as the spacing is varied between adjacent turns 18''. By any combination of these, the turns 18'' of the coil provide a non-linear inductance in response to linear incremental movement of the antenna portion 12 thereby maintaining the antenna resonant.

Figure 8:
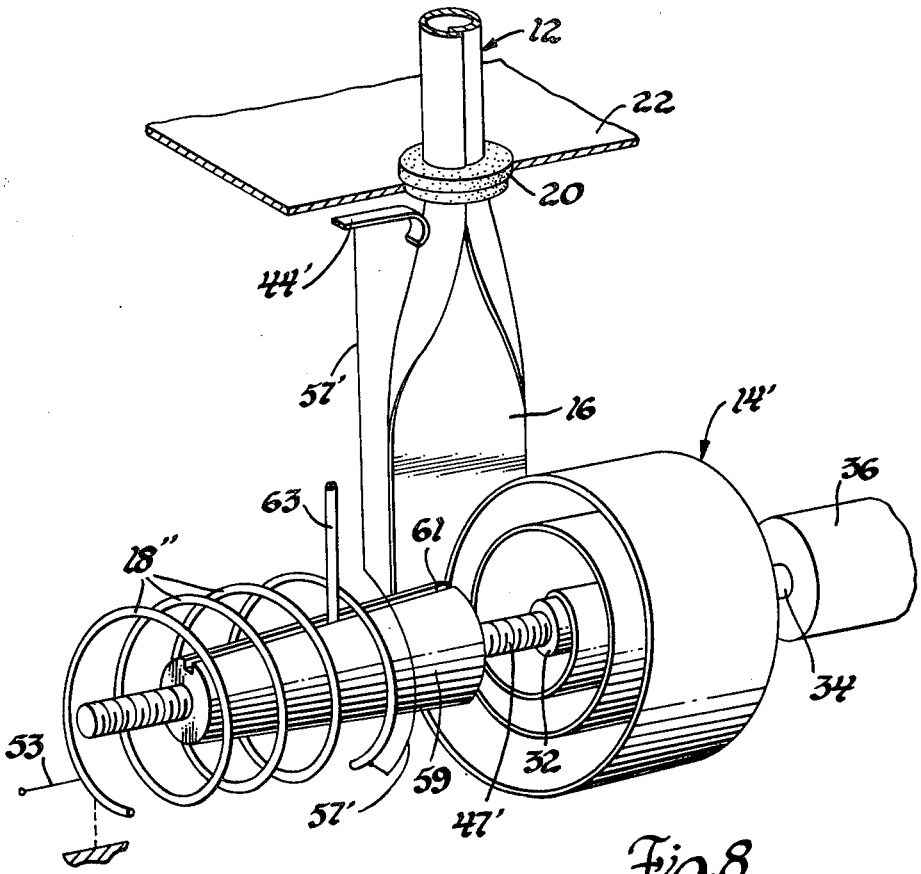
FIG. 8 is a schematic perspective view illustrating yet another embodiment of the subject invention.

A further embodiment is illustrated in FIG. 8 and differs from the embodiment of FIG. 7 in that the shaft 47' is threaded and engages a permeable core material 59. The core 59 includes slot 61 in which a stationary pin 63 is disposed. The permeable core 59 is cone-shaped or tapered from one end to the other for movement into and out of the area within the adjacent turns 18'' of the coil. As the shaft 47' is rotated while the strip 16 is being wound and unwound into the coil 14', it threadedly engages the permeable core 59 to move the core into and out of the turns 18'' thereby changing the permeability of the medium within the turns 18'' of the coil, which, in turn, varies the inductance of the coil. The RF signal passes through the lead 57' to the contact 44' which slidably engages the antenna portion 12. The core 59 is cone-shaped so as to non-linearly change the inductance provided by the coil in response to linear movement of the strip 16 as it is wound and unwound.

Figure 9:
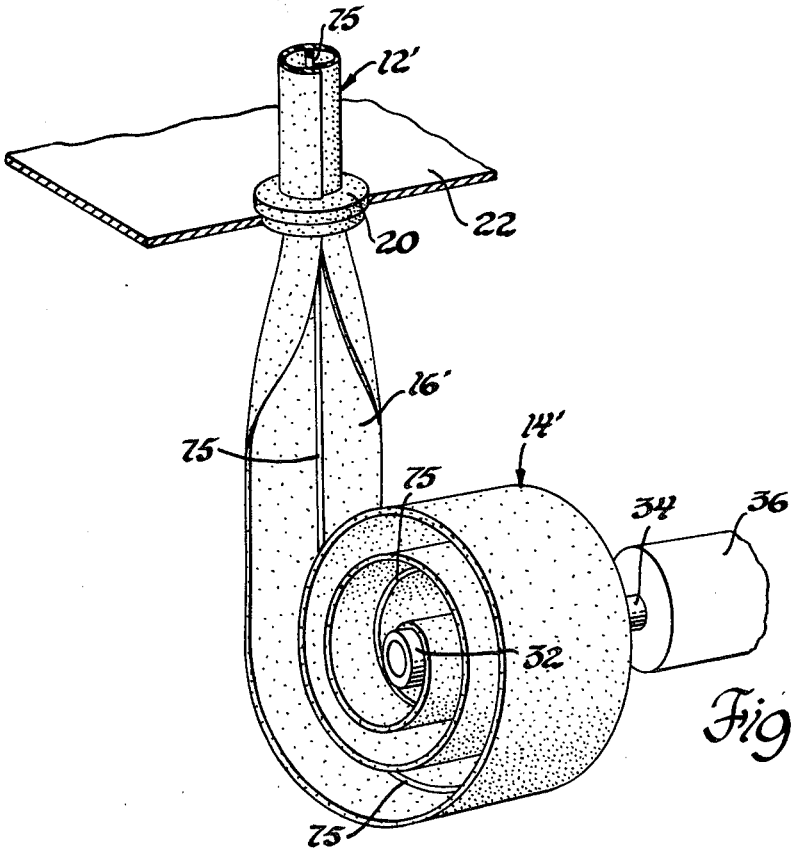
FIG. 9 is a schematic perspective view illustrating still another embodiment of the subject invention.

FIG. 9 illustrates still another embodiment which differs from the previous embodiments in that the strip 16' is made of a nonelectrical conducting medium such as plastic. The antenna and the coil are integral with one another and are defined by an electrically conductive length of wire, or the like, 75. The wire 75 defines an electrically conductive means extending continuously along the strip 16' for establishing the coil within the wound portion 14' and for establishing the antenna along the tubular length 12'. It will be appreciated that the strip 16' may be made of metal and the electrically conductive means 75 may be electrically isolated from the strip 16'. As illustrated, however, the strip 16' is made of nonconductive plastic whereas the wire 75 is conductive. Thus, the strip 16', by supporting the electrically conductive means 75, establishes an antenna in the tubular length 12' for radiating and receiving radio frequency energy and establishes an electrically continuous inductive coil having turns within the wound portion 14' for providing a varying inductance coupled with the antenna portion of the conductor 75. In other words, the inductance of the embodiment of FIG. 9 is varied upon the winding and unwinding of the strip 16' between the tubular length 12' and the wound portion 14'. It will be appreciated that a spacing strip like that of FIG. 1 or other means may be utilized in the embodiment of FIG. 9 to vary the spacing of the coils to non-linearly vary the inductance of the coiled wire 75.

As will be appreciated from the various embodiments, the varying means for varying the inductance of the coils may vary the inductance by: changing the diameter of the turns of the coil; changing the number of turns of the coil; changing the spacing between adjacent turns of the coil; changing the permeability of the medium within the turns of the coil; or changing any combination thereof. The important factor is that the inductance provided by the coil changes non-linearly in response to linear movement of the antenna portion as the coil is mechanically coupled to the antenna and is responsive to the extended position of the antenna portion of the assembly.

Thus, there are described above various embodiments of an extendable antenna assembly including an elongated antenna for radiating and receiving radio frequency energy and being extensible and retractable longitudinally of its length between a retracted position and a fully extended position (which positions may be determined by limit switches, or the like) and tuning means for automatically maintaining the antenna resonant to a predetermined frequency in correlation with and responsive to the extended position of the antenna.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. An extensible antenna assembly comprising; an elongated antenna for radiating and receiving radio frequency energy and being extensible and retractable longitudinally of its length between a retracted position and fully extended position; and tuning means for automatically maintaining said antenna resonant at a single predetermined frequency in correlation with and responsive to the various extended positions of said antenna.

2. An assembly as set forth in claim 1 wherein said tuning means comprises variable inductive reactance means coupled with said antenna.

3. An assembly as set forth in claim 2 wherein said inductive reactance means is mechanically coupled with said antenna for varying in response to extensive and retractive movement of said antenna.

4. An assembly as set forth in claim 3 wherein said inductive reactance means comprises an inductive coil.

5. An assembly as set forth in claim 4 including varying means for changing any of the diameter of the turns of the coil, the number of turns of the coil, the spacing between turns of the coil, and the permeability of the medium within the turns of the coil.

6. An assembly as set forth in claim 4 including varying means for varying the inductance of said coil nonlinearly in response to linear movement of said antenna.

7. An assembly as set forth in claim 6 including drive means for moving said antenna and for simultaneously operating said varying means.

8. An assembly as set forth in claim 7 wherein said coil is integral with said antenna whereby the coil and antenna are electrically and mechanically continuous and said coil unwinds into said antenna upon the extension thereof.

9. An assembly as set forth in claim 4 including varying means for varying the inductance of said coil.

10. An assembly as set forth in claim 9 wherein said varying means includes a movable contact for moving along said coil in response to said movement of said antenna.

11. An assembly as set forth in claim 9 where said coil is integral with said antenna.

12. An assembly as set forth in claim 9 wherein said coil is integral with said antenna whereby the coil and antenna are electrically continuous and said coil unwinds into said antenna upon extension thereof.

13. An assembly as set forth in claim 12 including a coiled strip extending from said coil and into a tubular configuration establishing said antenna.

14. An assembly as set forth in claim 13 wherein said strip is metal and comprises said coil and said antenna.

15. An assembly as set forth in claim 14 including insulating means for electrically insulating the turns of said coil from one another.

16. An assembly as set forth in claim 9 wherein said varying means comprises material disposed within said coil for varying the permeability within the turns of said coil.

17. An assembly as set forth in claim 9 wherein said varying means includes a conical spindle having a spiraled support ledge for supporting and spacing the turns of the coil.

18. An extensible antenna assembly comprising: an elongated member having a retracted position in which at least a major length thereof is wound into a wound portion having turns, and a fully extended position in which a length thereof defines an elongated portion; said elongated member establishing an antenna in said elongated portion for radiating and receiving radio frequency energy and establishing an inductive coil having turns in said wound portion and electrically continuous with said antenna for providing a varying inductance coupled with said antenna and varying upon the winding and unwinding of said member between said extended position and said wound position.

19. An antenna assembly as set forth in claim 18 wherein said member is electrically conductive and defines said antenna and said coil.

20. An assembly as set forth in claim 19 including insulating means for electrically insulating the turns of said coil from one another.

21. An assembly as set forth in claim 19 including insulating means for electrically insulating the turns of said coil in said wound portion from one another and non-linearly varying the inductance of said coil in response to linear movement of said member.

22. An assembly as set forth in claim 21 including drive means for winding and unwinding said member.

23. An assembly as set forth in claim 18 including an electrically conductive means extending continuously along said member for establishing said coil and said antenna.

24. An assembly as set forth in claim 23 including varying means for non-linearly varying the inductance of said coil in response to linear movement of said member.

25. An assembly as set forth in claim 24 including drive means for winding and unwinding said member.

26. An assembly as set forth in claim 18 including varying means for non-linearly varying the inductance of said coil in response to linear movement of said member.

* * * * *